US007966669B1

(12) United States Patent
Siepmann

(10) Patent No.: US 7,966,669 B1
(45) Date of Patent: Jun. 28, 2011

(54) SURVIVAL COVERALLS WITH ADJUSTABLE LIMBS

(75) Inventor: Helm Siepmann, White Rock (CA)

(73) Assignee: Apex Outdoor Innovations Corporation, Surrey, British Columbia ( * ) Notice: Subject to any disclaimer, the term of this patent is extended or adjusted under 35 U.S.C. 154(b) by 137 days.

(21) Appl. No.: 12/013,974

(22) Filed: Jan. 14, 2008

Related U.S. Application Data

(60) Provisional application No. 60/880,677, filed on Jan. 13, 2007.

(51) Int. Cl.
*A41B 7/00* (2006.01)

(52) U.S. Cl. ..... 2/123

(58) Field of Classification Search ..... 2/22–24, 2/79, 69, 129, 108, 123, 97
See application file for complete search history.

(56) References Cited

U.S. PATENT DOCUMENTS

| | | | | |
|---|---|---|---|---|
| 4,117,552 | A | 10/1978 | Simpson | |
| 4,149,275 | A | 4/1979 | Sanchez | |
| 4,200,938 | A | 5/1980 | LeTourneau | |
| 4,543,670 | A * | 10/1985 | Ehring | 2/85 |
| 4,697,288 | A | 10/1987 | Palumbo | |
| 4,985,936 | A | 1/1991 | Jones | |
| 5,220,976 | A * | 6/1993 | Gunter | 182/3 |
| 5,299,323 | A | 4/1994 | Schaefer et al. | |
| 5,388,270 | A * | 2/1995 | Hewitt | 2/93 |
| 5,404,592 | A | 4/1995 | Jackson | |
| 5,535,453 | A | 7/1996 | Howard | |
| 5,539,932 | A | 7/1996 | Howard | |
| 5,575,010 | A | 11/1996 | Chung | |
| 5,890,226 | A * | 4/1999 | Snedeker et al. | 2/97 |
| 6,158,056 | A | 12/2000 | Riley | |
| 6,360,372 | B2 * | 3/2002 | Oster | 2/126 |
| 6,374,414 | B1 | 4/2002 | Collier | |
| 6,654,968 | B2 | 12/2003 | Braun et al. | |
| 6,817,029 | B2 * | 11/2004 | Mazzarolo | 2/22 |

* cited by examiner

*Primary Examiner* — Tejash Patel
(74) *Attorney, Agent, or Firm* — Eric Karich

(57) ABSTRACT

A survival coverall has a main suit and adjustable telescopic limbs. The main suit is adapted to provide coverage for a torso and shoulders of a wearer. The adjustable telescopic limbs, each comprise a cuff, an outer shell, and a fastener. The cuff and the outer shell extend from the main suit. The outer shell is attached to the cuff at a primary attachment point creating a cuff overlap with an exposed side and inner suit side. The fastener is attached to the cuff overlap on the inner suit side which allows the cuff to attach to the outer shell at an adjustable secondary attachment point either shortening or elongating the adjustable telescopic limb.

1 Claim, 4 Drawing Sheets

SURVIVAL COVERALLS WITH ADJUSTABLE LIMBS

CROSS-REFERENCE TO RELATED APPLICATIONS

This application for a utility patent claims the benefit of U.S. Provisional Application No. 60/880,677, filed Jan. 13, 2007. The previous application is hereby incorporated by reference in its entirety.

STATEMENT REGARDING FEDERALLY SPONSORED RESEARCH

Not Applicable

BACKGROUND OF THE INVENTION

1. Field of the Invention

This invention relates generally to survival coveralls, and more particularly to survival coveralls with adjustable limbs.

2. Description of Related Art

The following art defines the present state of this field:

Simpson, U.S. Pat. No. 4,117,552, teaches a protective coverall that includes excess fabric over the knees and elbows. The excess fabric is disposed in a series of tucks that ensures that the excess fabric coincides with the joints.

Braun et al., U.S. Pat. No. 6,654,968, teaches a garment having an expandable limb joint that is adapted to be closed with an annular zipper arrangement. Top and bottom portions of the garment are connecting with a connecting portion, but the two elements of the garment do not telescopically engage each other.

Howard, U.S. Pat. No. 5,535,453, teaches a garment having limbs that are adjustable in length using an adjustment mechanism at the bottom edge of the limb of the garment.

The above-described references are hereby incorporated by reference in full.

The prior art teaches adjustable limbs for survival coveralls. However, the prior art does not teach survival coveralls with telescopic limbs designed to substantially cover the wearer to protect him from harsh elements while adjusting to control bulk and maintain the mobility of the wearer. The present invention fulfills these needs and provides further related advantages as described in the following summary.

SUMMARY OF THE INVENTION

The present invention teaches certain benefits in construction and use which give rise to the objectives described below.

The present invention provides a survival coverall comprising a main suit and adjustable telescopic limbs. The main suit is adapted to provide coverage for a torso and shoulders of a wearer. The adjustable telescopic limbs, each comprise a cuff, an outer shell, and a fastener. The cuff and the outer shell extend from the main suit. The outer shell is attached to the cuff at a primary attachment point creating a cuff overlap with an exposed side and inner suit side. The fastener is attached to the cuff overlap on the inner suit side which allows the cuff to attach to the outer shell at an adjustable secondary attachment point either shortening or elongating the adjustable telescopic limb.

A primary objective of the present invention is to provide a survival coverall with adjustable limbs having advantages not taught by the prior art.

Another objective is to provide a survival coverall with adjustable limbs designed to decrease the bulking of excess material.

A further objective is to provide a survival coverall with adjustable limbs designed to increase the mobility of the wearer while wearing the survival coverall.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a survival coverall 10 with adjustable telescoping limbs 20.

Figure 1:
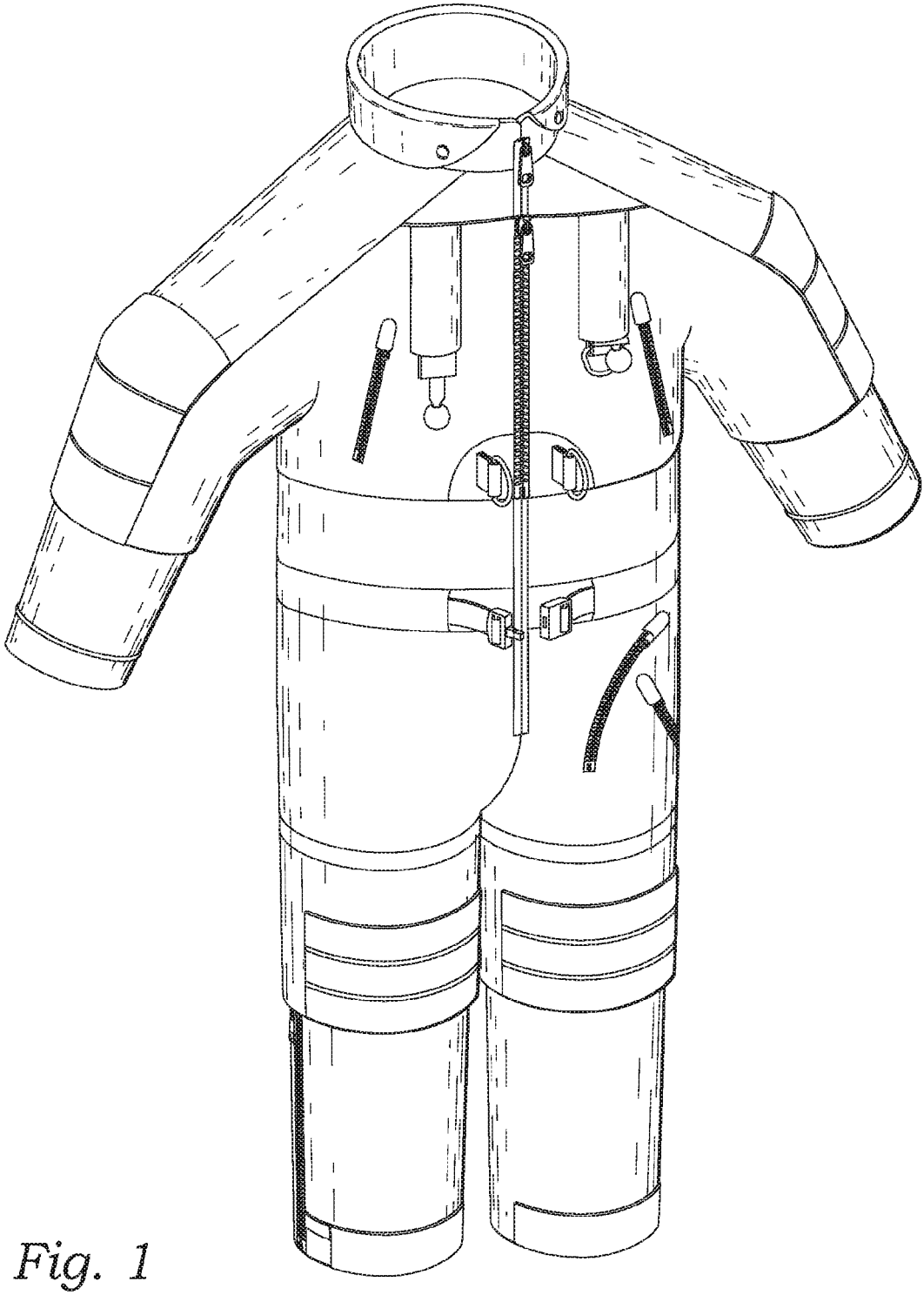
FIG. 1 is a perspective view of a survival coverall with adjustable telescoping limbs according to a preferred embodiment of the present invention.

FIG. 1 is a perspective view of a survival coverall 10 with adjustable telescoping limbs 20 according to a preferred embodiment of the present invention. As shown in FIG. 1, the survival coverall 10 comprises a main suit 12 providing coverage for a torso and shoulders of a wearer and adjustable telescopic limbs 20. The survival coverall 10 is designed to substantially cover the wearer to protect him from harsh elements while adjusting to control bulk and maintain the mobility of the wearer.

The survival coverall 10 may be constructed of a suitable insulating material that may be waterproof or water resistant. The survival coverall 10 may be constructed of a single layer of material, such as neoprene, or several layers of varying materials that suit the purposes of the coverall 10.

As shown in FIG. 1, in one embodiment, the survival coverall 10 includes a secondary outer vest 40 wearably connected to the main suit 12 and having a plurality of detailed components 42. The plurality of detailed components 42 may include attachments, access points, and/or sheaths for utilities that would aid the wearer in harsh conditions.

In one embodiment, examples of the plurality of detailed components 42 include an access point 44 that allows access to rings 46 attached to ends 48 of a safety harness 50 that passes around the perimeter of the secondary outer vest 40 through a channel 52. The plurality of detailed components 42 also includes sheaths 54 wearably attached to the secondary outer vest 40 for storage of a marine whistle and/or chemical glow sticks. In other embodiments, the survival coverall 10 could have multiple storage and access points wearably attached to aid the wearer in harsh conditions.

Figure 2:
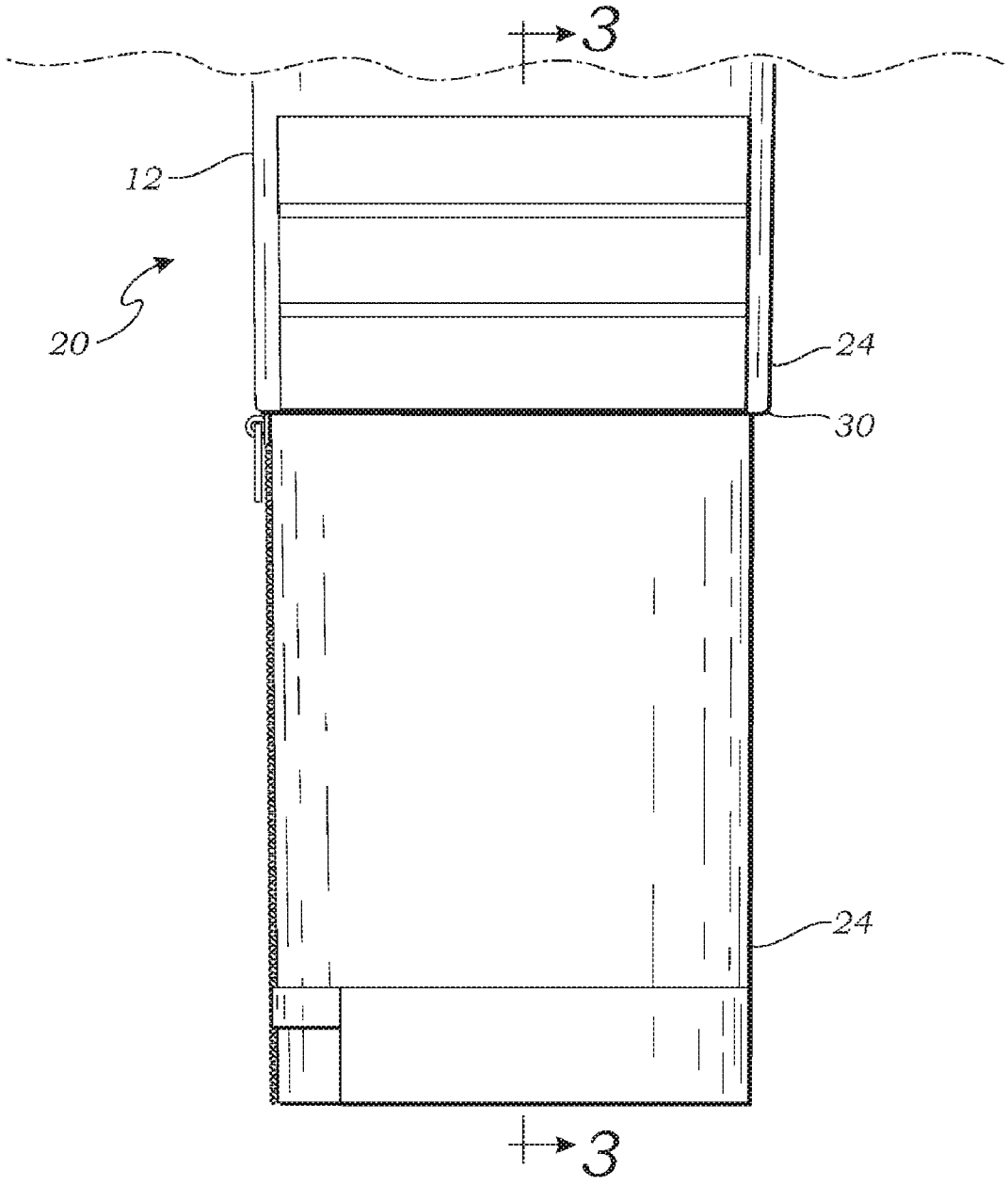
FIG. 2 is a close up view of the adjustable telescopic limb portion of the survival coverall.
Figure 3:
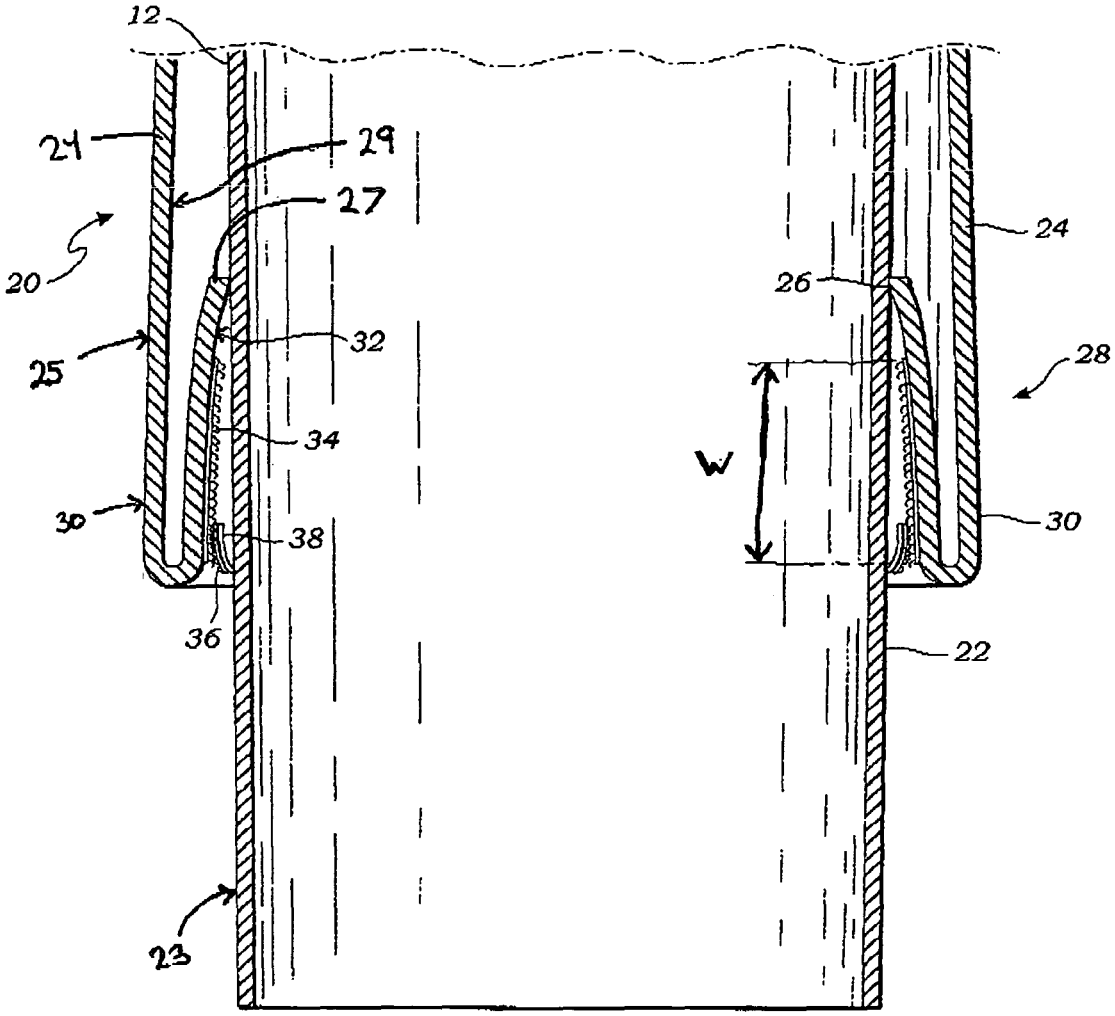
FIG. 3 is a sectional view thereof taken along the line 3-3 in FIG. 2.

FIG. 2 is a close up view of the adjustable telescopic limb 20 portion of the survival coverall, and FIG. 3 is a sectional view thereof taken along the line 3-3 in FIG. 2. As shown in FIGS. 2 and 3, each of the adjustable telescopic limbs 20 comprise a cuff 22 and an outer shell 24 extending from the main suit 12. The outer shell 24 is attached to the cuff 22 at a primary attachment point 26 creating a cuff overlap 28 with an exposed side 30 and inner suit side 32. A fastener 34 is attached to the cuff overlap 28 on the inner suit side 32 which allows the cuff 22 to attach to the outer shell 24 at an adjustable secondary attachment point 36 either shortening or elongating the adjustable telescopic limb 20.

The fastener 34 in this embodiment includes a hooks and loops fastener, such as Velcro®, attaching the inner suit side 32 of the outer shell 24 to a tab 38 extending from the cuff 22. In other possible embodiments, the fastener 34 could include any type of device such as a snap, buckle, or other form of attachment mechanism that would enable the wearer to easily shorten or elongate the adjustable telescopic limbs 20.

In one embodiment, the cuff has a cuff outer surface 23. The outer shell 24 has a shell outer surface 25 and an opposed shell inner surface 29, and extends to a terminal perimeter 27. The terminal perimeter 27 is attached to the cuff 22 at a primary attachment point 26 such that the outer shell 24 is folded back upon itself to create the cuff overlap 28, such that an exposed side portion 30 of the shell outer surface 25 faces outwardly away from the cuff 22, and an inner suit side portion 32 of the shell outer surface 25 faces towards the cuff 22. The hooks and loops fastener 34 has a width W and is attached to the inner suit side portion 32. The tab 36 has mating hooks and loops to enable the cuff 22 to be attached to the hooks and loops fastener 34 of the inner suit side portion 32 of the outer shell 24 at various adjustable secondary attachment points 36, thereby either shortening or elongating the adjustable telescopic limb 20.

Figure 4:
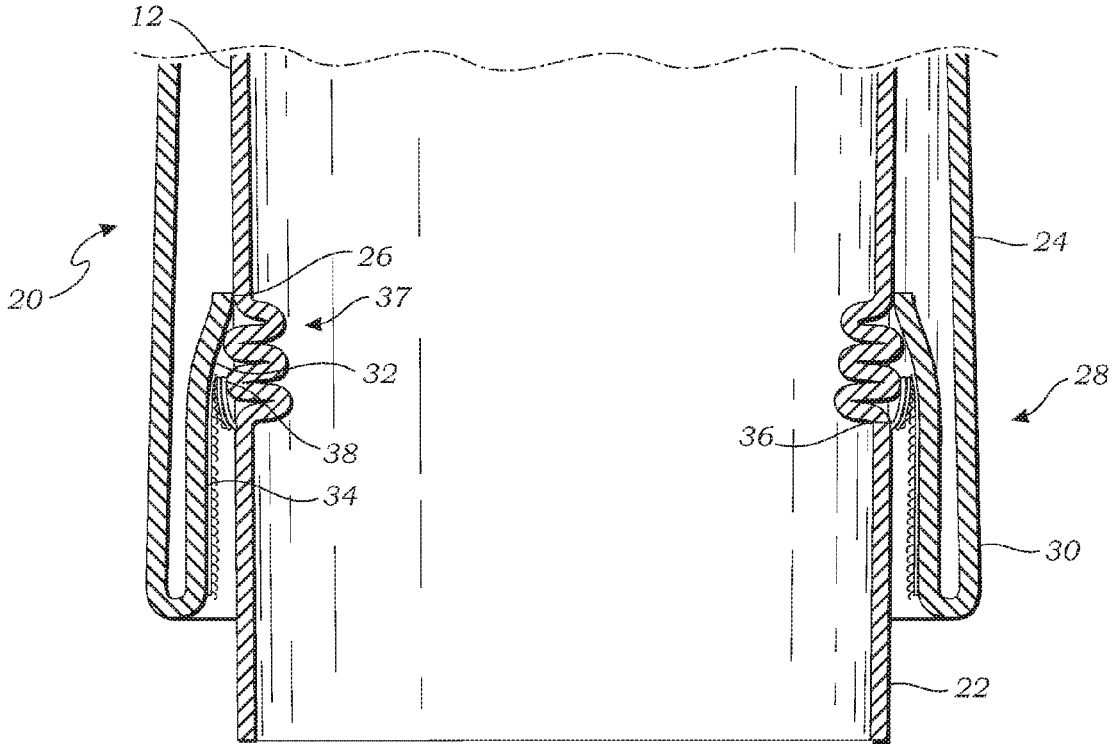
FIG. 4 is a sectional view similar to FIG. 3, illustrating a shortened position of the adjustable telescoping limb.

FIG. 4 is a sectional view similar to FIG. 3, illustrating a shortened position of the adjustable telescoping limb 20. As shown in FIG. 4, the tab 38 may be attached higher along the hooks and loops fastener 34 on the inner suit side 32 of the cuff overlap 28. The adjustable secondary attachment point 36 is then positioned higher than in FIG. 3 such that the adjustable telescoping limb 20 is shorter and excess suit material 37 is tucked beneath the inner suit side 32 of the cuff overlap 28. This allows the survival coverall 10 to more accurately fit the size of the wearer and decreases any bulking of material that might hinder mobility.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A survival coverall comprising:

a main suit adapted to provide coverage for a torso and shoulders of a wearer; and adjustable telescopic limbs, each comprising:

a cuff integrally formed with and extending from the main suit, the cuff having a cuff outer surface;

an outer shell having a shell outer surface and an opposed shell inner surface that extend to a terminal perimeter;

wherein the outer shell is attached to the main suit, and wherein the terminal perimeter is attached directly to the cuff at a primary attachment point, such that the outer shell is folded back upon itself to create a cuff overlap, such that an exposed side portion of the shell outer surface faces outwardly away from the cuff, and an inner suit side portion of the shell outer surface faces towards the cuff;

a hooks and loops fastener having a width is attached to the inner suit side portion; and a tab extending from the cuff, the tab having mating hooks and loops to enable the cuff to be attached to the hooks and loops fastener of the inner suit side portion of the outer shell at various adjustable secondary attachment points, such that the cuff may be gathered and folded between the tab and the primary attachment point, thereby either shortening or elongating the adjustable telescopic limb.

* * * * *